US006602553B2

(12) United States Patent
Heimberg et al.

(10) Patent No.: US 6,602,553 B2
(45) Date of Patent: Aug. 5, 2003

(54) PROCESS FOR PRODUCING A CERAMIC THERMAL BARRIER LAYER FOR GAS TURBINE ENGINE COMPONENT

(75) Inventors: Beate Heimberg, Berlin (DE); Wolfram Beele, Ratingen (DE); Karl Kempter, München (DE); Ulrich Bast, München (DE); Thomas Haubold, Weinheim (DE); Michael Hoffmann, Böblingen (DE); Axel Endriss, Stuttgart (DE); Peter Greil, Weisendorf (DE); Chu-Wan Hong, Stainz (DE); Fritz Aldinger, Leinfelden-Echtingen (DE); Hans J. Seifert, Stuttgart (DE)

(73) Assignees: Siemens Aktiengesellshaft, Munich (DE); Rolls-Royce Deutschland GmbH, Oberursel (DE)

( * ) Notice: Subject to any disclaimer, the term of this patent is extended or adjusted under 35 U.S.C. 154(b) by 0 days.

(21) Appl. No.: 10/187,504

(22) Filed: Jul. 1, 2002

(65) Prior Publication Data

US 2002/0164430 A1 Nov. 7, 2002

Related U.S. Application Data

(62) Division of application No. 09/562,877, filed on May 1, 2000, now Pat. No. 6,440,575, which is a continuation of application No. PCT/DE98/03205, filed on Nov. 3, 1998, now abandoned.

(30) Foreign Application Priority Data

Nov. 3, 1997 (DE) ..... 197 48 508

(51) Int. Cl.[7] ..... B05D 1/02; C23C 4/10

(52) U.S. Cl. ..... 427/421; 427/453; 427/567

(58) Field of Search ..... 427/453, 421, 427/567

(56) References Cited

U.S. PATENT DOCUMENTS 4,321,310 A 3/1982 Ulion et al. ..... 428/612
4,339,509 A 7/1982 Dardi et al. ..... 428/632
4,585,481 A 4/1986 Gupta et al. ..... 106/14.05

(List continued on next page.)

FOREIGN PATENT DOCUMENTS

| | | |
|---|---|---|
| DE | 3543802 | 6/1987 |
| EP | 0223083 | 5/1987 |
| EP | 0486489 | 2/1991 |

(List continued on next page.)

OTHER PUBLICATIONS

Sivakumar, R., et al. "On the Development of Plasma–Sprayed Thermal Barrier Coatings," *Oxidation of Metals*, vol. 20, nos. 3/4, pp. 67–73 (1983) no month.

Yagodkin, Y.D., et al., "Application of Ion–Beam Treatment in Turbine Blade Production Technology," *Surface and Coatings Technology*, vol. 84, pp. 590–592 (1996) no month.

Internationalen Recherchenbericht (International Search Report) in PCT/DE98/03092, Mar. 25, 1999.

(List continued on next page.)

*Primary Examiner*—Archene Turner
(74) *Attorney, Agent, or Firm*—David M. Quinlan, P.C.

(57) ABSTRACT

An article that is particularly well suited for use as a gas turbine engine component has a metallic substrate and a ceramic thermal barrier layer including a mixed metal oxide system comprising a compound selected from the group consisting of (i) a lanthanum aluminate and (ii) a calcium zirconate, the calcium in which is partially replaced by at least one calcium-substitute element, such as strontium (Sr) or barium (Ba). In addition, the lanthanum in the lanthanum aluminate can be partially replaced by a lanthanum-substitute element from the lanthanide group, particularly gadolinium (Gd). A process for producing such an article comprises providing a pre-reacted mixed metal oxide system as described above and applying it to the substrate by plasma spraying or an evaporation coating process.

7 Claims, 4 Drawing Sheets

U.S. PATENT DOCUMENTS

| | | | | |
|---|---|---|---|---|
| 4,764,341 | A | 8/1988 | Flaitz et al. | 419/9 |
| 4,971,839 | A | 11/1990 | Rohr et al. | 427/372.2 |
| 4,996,117 | A | 2/1991 | Chu et al. | 428/633 |
| 5,032,557 | A | 7/1991 | Taira et al. | 501/135 |
| 5,082,741 | A | 1/1992 | Taira et al. | 428/469 |
| 5,154,885 | A | 10/1992 | Czech et al. | 420/588 |
| 5,236,787 | A | 8/1993 | Grassi | 428/552 |
| 5,401,307 | A | 3/1995 | Czech et al. | 106/14.05 |
| 5,466,280 | A | 11/1995 | Lee et al. | 106/14.12 |
| 5,512,382 | A | 4/1996 | Strangman | 428/632 |
| 6,258,467 | B1 | 7/2001 | Subramanian | 428/472 |

FOREIGN PATENT DOCUMENTS

| | | |
|---|---|---|
| GB | 2243161 | 10/1991 |
| GB | 2286977 | 9/1995 |
| JP | 5393134 | 8/1978 |
| JP | 3226553 | 10/1991 |
| JP | 4036453 | 2/1992 |
| JP | 4231451 | 8/1992 |
| JP | 4231452 | 8/1992 |
| JP | 5279832 | 10/1993 |
| WO | WO 9102108 | 2/1991 |
| WO | WO 9635826 | 11/1996 |

OTHER PUBLICATIONS

Internationalen Recherchenbericht (International Search Report) in PCT/DE98/03205, Mar. 31, 1999.

Internationalen Vorläufigen Prüfungsberichts (International Preliminary Examination Report) in PCT/DE98/03092, Sep. 14, 1999.

Internationalen Vorläufigen Prüfungsberichts (International Preliminary Examination Report) in PCT/DE98/03205, Nov. 22, 1999.

PROCESS FOR PRODUCING A CERAMIC THERMAL BARRIER LAYER FOR GAS TURBINE ENGINE COMPONENT

CROSS-REFERENCE TO RELATED APPLICATIONS

This application is a division of application Ser. No. 09/562,877 filed May 1, 2000, now U.S. Pat. No. 6,440,575, which is a continuation of International Application PCT/DE98/03205, with an international filing date of Nov. 3, 1998, now abandoned.

BACKGROUND OF THE INVENTION

1. Field of the Invention

The present invention relates to a protective coating for an article exposed to hot, aggressive gas flows and, more particularly, to a ceramic thermal barrier layer for a gas turbine engine component.

2. Description of Related Art

Gases flowing through a turbine engine reach extremely high temperatures and velocities. It is a significant engineering challenge to build components that will withstand the impingement of a high velocity gas at temperatures that can exceed 1000° C. The demands on an engine's turbine blades are particularly extreme, because they are exposed to high velocity, high temperature gases while being subjected to forces resulting from rotation at thousands of revolutions per minute.

Prior art turbine blades are typically a laminated structure, with a so-called superalloy substrate or base body having a heat resistant coating. These superalloys are typically cobalt- or nickel-based materials, and the protective coatings have taken a variety of forms. One known component of such coatings is an adhesion promotion layer of an MCrAlY alloy, where Cr is chromium, Al is aluminum and Y is yttrium and/or a rare-earth element, with the remainder M selected from the group consisting of iron, cobalt, nickel or mixtures thereof. That layer forms a bonding oxide for a ceramic thermal barrier layer.

U.S. Pat. No. 4,585,481 discloses protective layers for protecting a superalloy metallic substrate against high-temperature oxidation and corrosion. MCrAlY alloys are employed for the protective layers, and the patent discloses such layers with 5% to 40% chromium, 8% to 35% aluminum, 0.1% to 2% of an oxygen-active element from group IIIb of the periodic table, including the lanthanides and actinides and mixtures thereof, 0.1% to 7% silicon and 0.1% to 3% hafnium, the remainder being made up of nickel and/or cobalt. (Proportions are in percentages by weight.) The corresponding protective layers made of MCrAlY alloys are, according to this patent, applied using a plasma-spray method.

U.S. Pat. No. 4,321,310 is another example of such prior art. It describes a gas turbine component which has a base body made of the nickel-based superalloy MAR-M-200. A layer of an MCrAlY alloy, in particular an NiCoCrAlY alloy, having 18% chromium, 23% cobalt, 12.5% aluminum and 0.3% yttrium, with the remainder being made up of nickel, is applied to the base material. This alloy layer has a polished surface, to which an aluminum oxide layer is applied. A ceramic thermal insulation layer, which has a columnar structure, is applied to this aluminum oxide layer. In the columnar microstructure of the thermal barrier layer, crystallite columns stand perpendicular to the surface of the base body. Stabilized zirconium oxide is disclosed as the ceramic material.

U.S. Pat. No. 5,236,787 discloses a layer of a metal-ceramic mixture between the base body and a ceramic thermal barrier layer of an internal combustion engine valve. The metallic component of the intermediate layer increases in the direction of the base body and decreases in the direction of the thermal barrier layer, while the ceramic component is low in the vicinity of the base body and high in the vicinity of the thermal barrier layer. The thermal barrier layer is a zirconium oxide stabilized with yttrium oxide and containing cerium oxide. The object is to match the different coefficients of thermal expansion.

U.S. Pat. No. 4,764,341 describes the bonding of a thin metal layer to a ceramic to produce printed electrical circuits. Nickel, cobalt, copper and alloys of these metals are used for the metal layer. To bond the metal layer to a ceramic substrate, an intermediate oxide, such as aluminum oxide, chromium oxide, titanium oxide or zirconium oxide, is applied to the ceramic substrate. The intermediate oxide forms a ternary oxide through oxidation at a sufficiently high temperature by incorporating an element from the metallic coating.

GB 2 286 977 describes a composition for an inorganic coating for application to a low-alloy steel and being resistant to high temperatures. A main property of the coating is its resistance to corrosion, which is achieved by binding iron in the coating. Before a chemical reaction, the coating includes metal oxides which are converted into spinels at temperatures in excess of 1000° C.

U.S. Pat. No. 4,971,839 discloses a high-temperature protection layer comprising a mixed metal oxide system which has a perovskite structure with the chemical structural formula $A_{1-x}B_xMO_3$. In this formula, A is a metal from group IIIb of the periodic table, B is a metal from main group II (alkaline-earth metals) of the periodic table and M is a metal from one of the groups VIb, VIIb and VIIIb of the periodic table. The stoichiometric factor x is between 0 and 0.8. The coating is employed on a thermally stable steel or an alloy for use at temperatures in excess of 600° C., in particular for a component of a gas turbine. An austenitic material based on nickel, cobalt or iron is preferably used as the component base material.

Sivakumar, R., et al., "On the Development of Plasma-Sprayed Thermal Barrier Coatings," *Oxidation of Metals*, Vol. 20, Nos. 3/4, pp. 67–73 (1983), disclose a variety of coatings which include a zirconate. The coatings are applied to components made of Nimonik-75 and, alternatively, an adhesion layer of the CoCrAlY type by means of plasma spraying. Results are given relating to calcium zirconates and magnesium zirconates under cyclic thermal loading.

In spite of the use of material such as partially stabilized zirconium oxide, ceramic thermal barrier layers have had a coefficient of thermal expansion which amounts to at most about 70% of the coefficient of thermal expansion of the common metallic base body made of a superalloy. Owing to the coefficient of thermal expansion of the zirconium oxide thermal barrier layer, which is lower than that of the metallic base body, thermal stresses result from exposure to a hot gas of articles with prior art protective coatings.

To counteract such stresses during thermal loading cycles, it is necessary to have an expansion-tolerant microstructure in the thermal barrier layer, for example, by setting up a corresponding porosity or a columnar structure in such layer. In the case of prior art thermal barrier layers based on partially stabilized zirconium oxide with stabilizers such as yttrium oxide, cerium oxide and lanthanum oxide, stresses resulting from a thermally induced phase transition (tetragonal to monoclinic and cubic) may occur. A concomitant change in volume dictates a maximum permissible surface temperature for zirconium oxide thermal barrier layers.

SUMMARY OF THE INVENTION

It is an object of the present invention to avoid the shortcomings of prior art structure for protecting articles in demanding environments, and particularly to provide a ceramic thermal barrier for protecting gas turbine engine components such as turbine blades.

It is another object of the present invention to provide a product having a metallic base body and a thermal barrier layer bonded thereon, in particular with a mixed metal oxide system.

In furtherance of the objects of the present invention, one aspect of the invention involves an article having a metallic substrate and a ceramic thermal barrier layer including a mixed metal oxide system comprising a compound selected from the group consisting of (i) a lanthanum aluminate and (ii) a calcium zirconate, the calcium in which is partially replaced by at least one calcium-substitute element.

In accordance with a more particular aspect of the invention, the calcium-substitute element is strontium (Sr) or barium (Ba). In addition, the lanthanum in the lanthanum aluminate can be partially replaced by at least one lanthanum-substitute element from the lanthanide group, particularly gadolinium (Gd).

In accordance with yet another aspect of the invention, a process for producing a thermal barrier layer on an article comprising a substrate for accepting the thermal barrier layer comprises the steps of providing a pre-reacted mixed metal oxide system comprising a compound selected from the group consisting of (i) a lanthanum aluminate and (ii) a calcium zirconate, the calcium in which is partially replaced by at least one calcium-substitute element, and applying the pre-reacted metal oxide system to said substrate by one of plasma spraying and an evaporation coating process.

The invention is particularly adapted for use with a component of a gas turbine engine such as a turbine blade, a guide vane or a heat shield element, in which the component substrate is a nickel-, cobalt- or chromium-based superalloy.

BRIEF DESCRIPTION OF THE DRAWINGS

Exemplary embodiments of the invention are explained in more detail with reference to the accompanying figures, in which.

Figure 2:
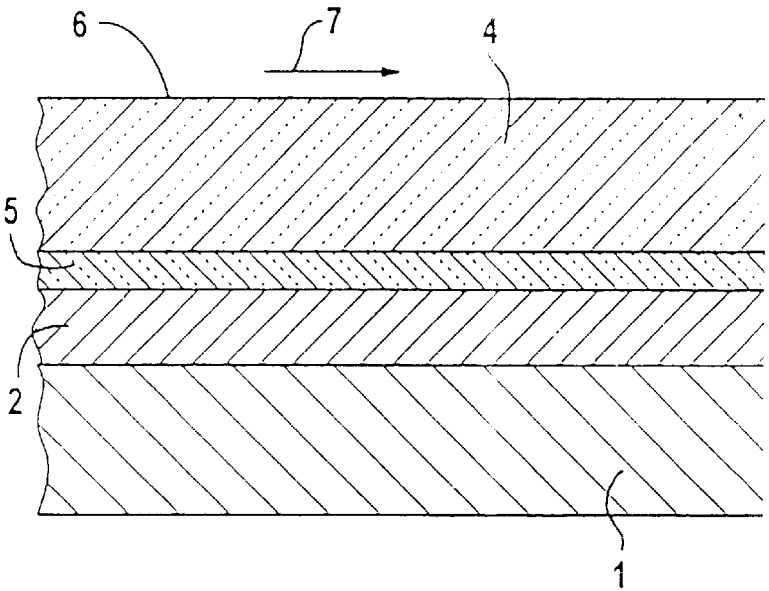
FIG. 2 is a sectional view through the blade taken at the line II—II in FIG. 1.

In the drawings, the same components are given the same reference numbers or letters in the different figures. It will be understood that the drawings illustrate exemplary embodiments diagrammatically and are not necessarily drawn to scale, in order to better represent the features of the embodiments described herein.

DETAILED DESCRIPTION OF PREFERRED EMBODIMENTS

Figure 1:
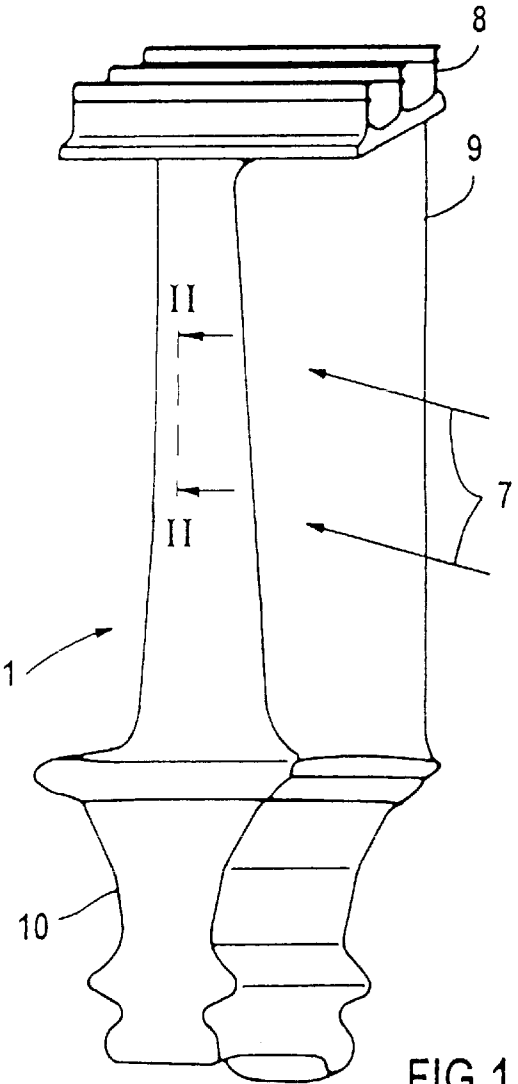
FIG. 1 shows a perspective representation of a gas turbine engine turbine blade.

Referring to FIGS. 1 and 2, the turbine blade 1 has a metallic base or substrate made of a nickel-based/cobalt-based or chromium-based superalloy. A layer system, described in more detail below, includes an adhesion promotion layer 2, a thermal barrier layer 4 and an intermediate oxide layer 5. The outer surface 6 of the layer system protects the blade 1 from hot gases 7 impinging on the blade during operation of the gas turbine engine (not shown) of which the blade is a part. Starting at a radially outward portion of the blade 1, it includes a sealing strip 8, a main span 9 having the layer system thereon, and a blade root 10 that holds the blade in place in a turbine rotor (not shown) in a conventional manner.

The adhesion promotion layer 2 may be an MCrAlY-type alloy, typically comprising chromium, aluminum, yttrium, lanthanum and/or zirconium, the remainder being one or several of the elements of iron, cobalt and nickel. Suitable formulations therefor are discussed in more detail below.

The thermal barrier layer 4 having a mixed metal oxide system is disposed over the adhesion promotion layer 2. The mixed metal oxide system preferably contains lanthanum aluminate ($LaAlO_3$), it being possible for the lanthanum to be partially replaced by, for example, gadolinium. The mixed metal oxide system may also, as an alternative, contain calcium zirconate with partial substitution of the calcium by strontium ($Ca_{1-x}Sr_xZrO_3$). A further oxide, such as aluminum oxide or zirconium oxide, is preferably added to the ternary oxide ($LaAlO_3$, $Ca_{1-x}Sr_xZrO_3$).

The oxide layer 5 containing a bonding oxide is formed between the adhesion promotion layer 2 and the thermal barrier layer 4. The bonding oxide is preferably produced by oxidation of the adhesion promotion layer 2, which when lanthanum is present therein leads to the formation of lanthanum oxide, and when zirconium is present therein leads to the formation of zirconium oxide. The oxide layer 5 promotes good bonding of the thermal barrier layer 4 via the adhesion promotion layer 2 to the metallic substrate of the blade 1.

Accordingly, a hot aggressive gas flow 7 past the outer surface 6 is effectively kept away from the blade's metallic substrate by the ceramic thermal barrier layer 4 and the adhesion promotion layer 2. This promotes a long life span even if the gas turbine blade is subjected to thermal loading cycles.

Figure 3:
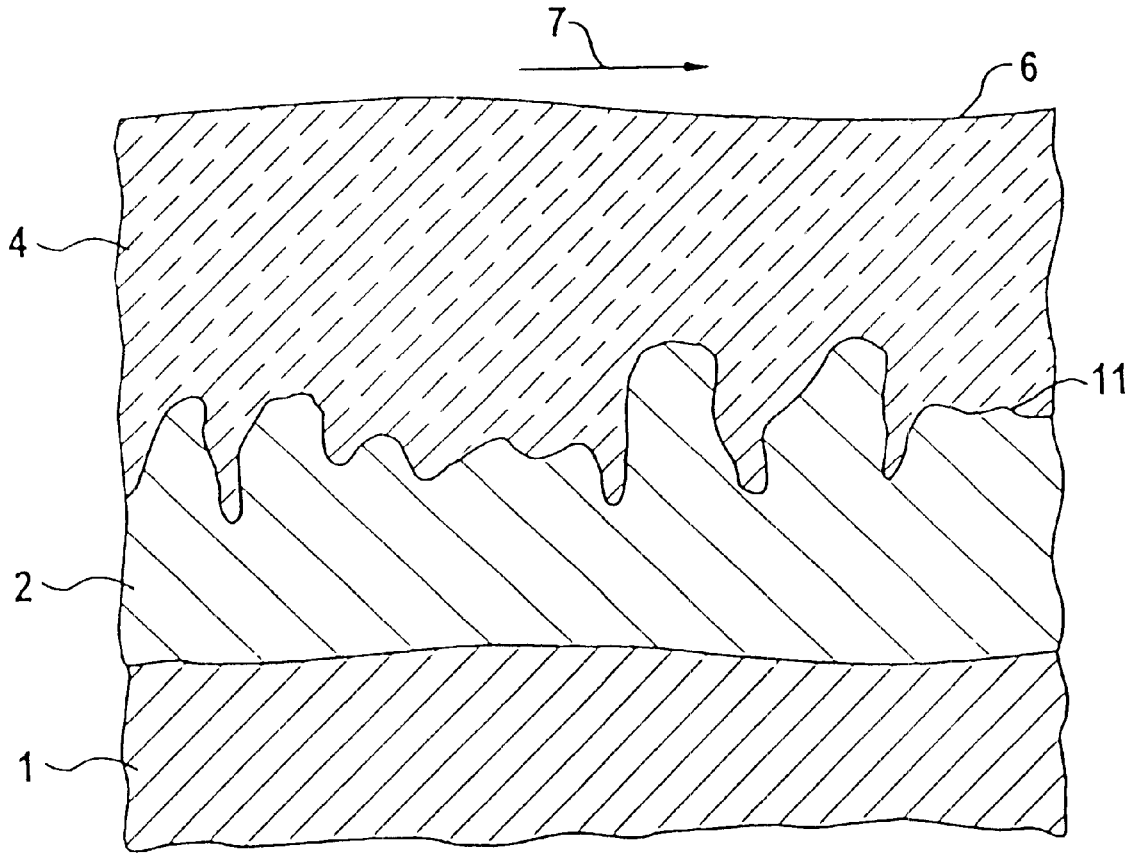
FIG. 3 is a sectional view taken at line II—II of an alternate embodiment of a turbine blade in accordance with another embodiment of the invention.

FIG. 3 depicts a layer system similar to that shown in FIG. 2, but in which an adhesion promotion layer 2 is applied to the blade substrate and the thermal barrier layer 4 is applied to the layer 2. In this case, the adhesion promotion layer surface 11 is sufficiently rough to bind the thermal barrier layer 4 essentially without chemical bonding. This is accomplished by mechanical interlocking of the layer 4 and the adhesion promotion layer 2. The requisite surface roughness may be brought about through the manner of application of the adhesion promotion layer 2. For example, vacuum spraying (plasma spraying) may be used in which already pre-reacted substances (for example $La_{1-x}Gd_xAlO_3$ or $Ca_{1-x}Sr_xZrO_3$) are applied to the product. This means that the substances are produced in a working step prior to the actual coating, and then applied substantially without further chemical reactions and conversions.

It should also be noted that direct application of the thermal barrier layer 4 to the blade substrate may also be brought about by corresponding roughness of the substrate. It is likewise possible to apply an additional bonding layer, for example, one containing an aluminum nitride or a chromium nitride, between-the adhesion promotion layer 2 and the thermal barrier layer 4.

Figure 4:
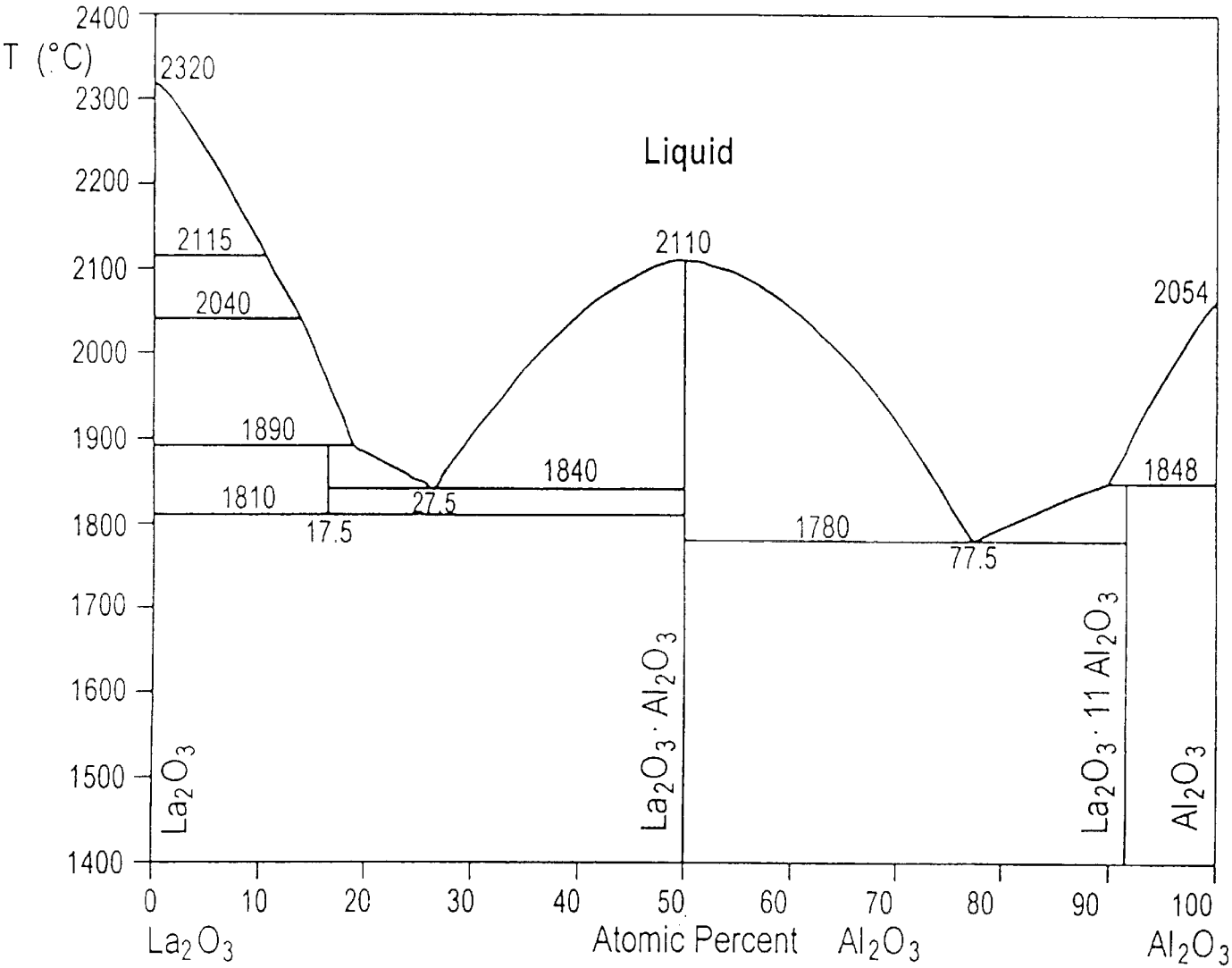
FIG. 4 is a phase diagram of lanthanum aluminate with the addition of lanthanum oxide and aluminum oxide.
Figure 5:
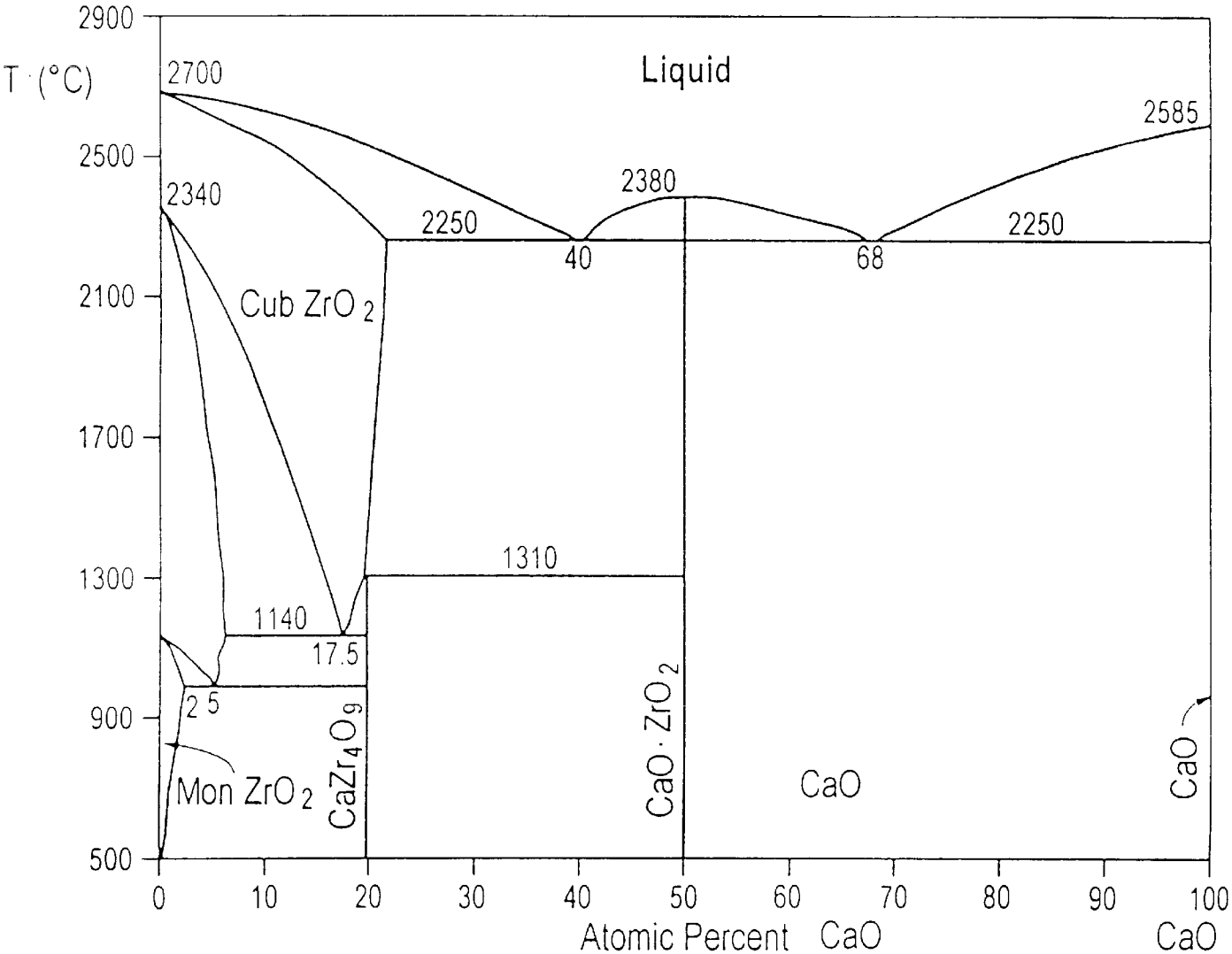
FIG. 5 is a phase diagram for calcium zirconate when zirconium oxide and calcium oxide are added.

It can be seen in the lanthanum aluminate phase diagram in FIG. 4 and the calcium zirconate phase diagram in FIG. 5, that with suitable selection of the oxide additives, a melting temperature significantly in excess of 1750° C. and high phase stability without phase transition at operating temperatures in excess of 1250° C. may be obtained.

According to one aspect of the present invention, the ceramic thermal barrier layer 4 contains a mixed metal oxide system comprising lanthanum aluminate and/or calcium zirconate. The thermal barrier layer is bonded directly or indirectly by an adhesion promotion layer to the blade substrate. The bonding preferably takes place via an oxide layer which, for example, is formed by oxidation of the substrate or the adhesion promotion layer. The bonding may also, or additionally, take place via mechanical interlocking, for example, through surface roughness of the blade substrate or the adhesion promotion layer.

The thermal barrier layer has a low thermal conductivity, a high melting point and chemical inertness. The term lanthanum aluminate as used above is intended to mean a mixed oxide, in a preferred embodiment having a perovskite structure in which the lanthanum is partially replaced by a substitute element. It is possible for the aluminum also to be at least partially replaced by a further substitute element. A chemical structural formula of the type $La_{1-x}M_xAl_{1-y}N_yO_3$ may be indicated for the relevant lanthanum aluminate. In this formula, M stands for a substitute element, which preferably comes from the lanthanide (rare-earth) group and N stands for chromium, for example. More preferably, the substitute element is in this case gadolinium (Gd). The substitution factor x may in this case be up to 0.8. It is preferably in the region of about 0.5, such that the thermal conductivity of such a lanthanum aluminate has a minimum, and the thermal barrier layer therefore has a particularly low thermal conductivity. The substitution factor y is preferably in the region of 0.

In addition or as an alternative, the mixed metal oxide system contains calcium zirconate, preferably in a perovskite structure, the calcium being partially replaced by at least one substitute element, in particular strontium (Sr) or barium (Ba). A chemical structural formula of the type $Ca_{1-x}Sr_xZr_{1-y}M_yO_3$ may be indicated for such a calcium zirconate. The substitution factor x is in this case from greater than 0 to 1, in particular greater than 0.2, and less than 0.8. It is preferably in the region of 0.5, such that the calcium zirconate likewise has a thermal conductivity minimum, and the thermal conductivity of the thermal barrier layer is also especially low. It is likewise possible to use a mixed oxide system with barium zirconate or strontium zirconate, ($Ba_{1-x}X_xZr_{1-y}M_yO_3$, $Sr_{1-x}X_xZr_{1-y}M_yO_3$), with X being Ca, Sr or M being Ti or Hf.

The lanthanum aluminates and the calcium, strontium or barium zirconate mixed crystals will be referred to as ternary oxide or pseudo-ternary oxide, respectively. A ternary oxide means an oxide in which oxygen (anions) is bonded to two further elements (cations). The term pseudo-ternary oxide is intended to mean a substance which per se contains atoms of more than two different chemical elements (cations). However, these atoms (cations) belong to only two different element groups, the atoms of the individual elements in each one of the three different element groups having similar effects in terms of crystallography.

The ternary oxide is preferably based on elements which form materials in the perovskite group, corresponding formation of mixed crystals and microstructure modification being allowed. The two different valence-defined forms of perovskite, namely A perovskite ($A^{2+}B^{4+}O_3$) and B perovskite ($A^{3+}B^{3+}O_3$) may occur. Coating materials with a perovskite structure have the general chemical structural formula $ABO_3$. The ions labeled as the A site occupiers are smaller than the ions referred to as the B site occupiers. The perovskite structure has 4 atoms in a unit cell. The perovskite structure can therefore be characterized in that the larger B ions and the O ions together form cubic close packing, in which ¼ of the octahedral sites are occupied by A ions. The B ions are in each case coordinated with 12 O ions in the form of a cubooctahedron, and the O ions in each case have 4 B ions and 2 A ions adjoining them.

The ternary oxide is preferably lanthanum aluminate ($LaAlO_3$) or calcium zirconate ($CaZrO_3$). These ternary oxides have little susceptibility to sintering, a high thermal conductivity and a high coefficient of thermal expansion. They furthermore possess a high degree of phase stability and a high melting point.

The coefficient of thermal expansion of the ternary oxide is preferably between $7\times10^{-6}$/K and $17\times10^{-6}$/K. The thermal conductivity is preferably between 1.0 and 4.0 W/mK. The ranges of values indicated for the expansion coefficient and the thermal conductivity are valid for bodies made of a pore-free ternary material. Through deliberately introduced porosity, the thermal conductivity can be reduced further. The melting temperature is considerably in excess of 1750° C.

Calcium zirconate has an expansion coefficient at a temperature between 500 and 1500° C. of $15\times10^{-6}$/K and a thermal conductivity of about 1.7 W/mK. The lanthanum aluminate ($LaAlO_3$) has a coefficient of thermal expansion of about $10\times10^{-6}$/K at a temperature in the range of from about 500 to 1500° C. The thermal conductivity is about 4.0 W/mK. Lanthanum aluminate and calcium zirconate can be synthesized as perovskite by conventional methods, such as for example the so-called mixed oxide method. After only about 3 hours of reactive annealing (at 1400° C. for $CaZrO_3$ and at 1700° C. for $LaAlO_3$) in air, the ternary oxide is present in essentially phase-pure form. Through full conversion of the lanthanum oxide ($La_2O_3$) used during production, a two-phase character is reliably avoided. Calcium zirconate is suitable, in particular, for its ease of production, its favorable phases or variable crystal chemistry, in particular the exchange of zirconium by titanium and hafnium. It is furthermore sprayable. Lanthanum aluminate has very little susceptibility to sintering and favorable adhesion conditions, which are in particular due to the aluminum.

The mixed oxide system may include a further oxide, the ceramic thermal barrier layer permitting a higher surface temperature and a longer operating time than a zirconium oxide thermal barrier layer. The further oxide may be calcium oxide (CaO) or zirconium oxide ($ZrO_2$) or a mixture thereof, in particular when the ternary oxide is calcium zirconate.

The ternary oxide may contain magnesium oxide (MgO) or strontium oxide (SrO) as an additional oxide. It is likewise possible for the ternary oxide to contain, as oxide, yttrium oxide ($Y_2O_3$), scandium oxide ($Sc_2O_3$) or a rare-earth oxide as well as a mixture of these oxides.

The lanthanum aluminate may, as a further oxide, contain aluminum oxide together with zirconium oxide and, possibly yttrium oxide. As an alternative, the mixed oxide system may additionally contain hafnium oxide ($HfO_2$) and/or magnesium oxide (MgO) with the ternary oxide.

The adhesion promotion layer is preferably an alloy comprising one of the elements of the mixed metal oxide system, in particular of the ternary oxide, for example, lanthanum, zirconium, aluminum or the like. An MCrAlY-type alloy is suitable as the adhesion promotion layer, in particular, when a base body made of a nickel-based/cobalt-based or chromium-based superalloy is being used. In this case, M stands for one of the elements or several elements from the group comprising iron, cobalt or nickel, Cr stands for chromium and Al stands for aluminum. Y stands for yttrium, cerium, scandium or an element from group IIIb of the periodic table, as well as the actinides or lanthanides. The MCrAlY alloy may contain further elements, for example, rhenium. An advantageous adhesion promotion layer is disclosed in U.S. Pat. No. 6,416,882, corresponding to International Application No. PCT/DE98/03092.

With a thermal barrier layer according to the invention, a greater withstand time can be achieved than for conventional zirconium oxide thermal barrier layers, in particular in the case of gas turbine blades under full-load operation of the gas turbine, even at an operating temperature of 1250° C. at the surface of the thermal barrier layer. A ternary oxide, in particular in the form of a perovskite, does not undergo any phase transition at the operating temperature of the gas turbine, which may be in excess of 1250° C., in particular up to about 1400° C.

The thermal barrier layer is preferably applied by atmospheric plasma spray with a predetermined porosity. It is likewise possible to apply the metallic mixed oxide system by means of a suitable evaporation coating process or a suitable PVD process (physical vapor deposition), in particular a reactive PVD process. When applying the thermal barrier layer by means of an evaporation coating process such as by electron-beam PVD, a columnar structure may also be achieved, if necessary.

In the case of a reactive PVD process, a reaction, in particular a conversion, of the individual constituents of a ternary oxide or of a pseudo-ternary oxide does not take place until during the coating process, namely directly after arrival on the product. In the case of an unreactive evaporation coating process, the already pre-reacted products, in particular the ternary oxides with a perovskite structure, are evaporated and then re-deposited from the vapor on the product. The use of pre-reacted products is especially advantageous, in particular, when a plasma spraying process is being used.

It will be appreciated that the present invention is useful in any environment in which an article is subject to hot, aggressive gas flows. It is particularly useful for components of gas turbine engines, such as turbine blades, guide vanes or a heat-shield elements.

Although preferred embodiments of the invention have been depicted and described, it will be understood that various modifications and changes can be made other than those specifically mentioned above without departing from the spirit and scope of the invention, which is defined solely by the claims that follow.

What is claimed is:

1. A process for producing a thermal barrier layer on an article comprising a substrate for accepting said thermal barrier layer, said process comprising the steps of:

providing a pre-reacted mixed metal oxide system comprising (i) a lanthanum aluminate or (ii) a calcium zirconate, the calcium in which is partially replaced by at least one calcium-substitute element selected from the group consisting of strontium and barium; and applying said pre-reacted metal oxide system to said substrate by one of plasma spraying and an evaporation coating process.

2. A process according to claim 1, wherein the lanthanum in said lanthanum aluminate is partially replaced by at least one lanthanum-substitute element from the lanthanide group, other than lanthanum.

3. A process according to claim 2 wherein said lanthanum aluminate has the formula $La_{1-x}M_xAl_{1-y}N_yO_3$, M being said lanthanum-substitute element, x being a substitution factor for M, N being a substitute element for aluminum in said lanthanum aluminate, and y being a substitution factor for N.

4. A process according to claim 3, wherein x is between 0 and 0.8.

5. A process according to claim 1, wherein said calcium zirconate has the formula $Ca_{1-x}Sr_xZr_{1-y}M_yO_3$, x being a substitute factor for calcium in said calcium zirconate, M being a substitute element for zirconium in said calcium zirconate, and y being a substitution factor for M.

6. A process according to claim 5, wherein x is between 0 and 0.8.

7. A process according claim 1, wherein said thermal barrier layer has a perovskite structure.

* * * * *